US007882885B2

(12) United States Patent
Bullied et al.

(10) Patent No.: US 7,882,885 B2
(45) Date of Patent: Feb. 8, 2011

(54) SYSTEMS AND METHODS FOR REDUCING THE POTENTIAL FOR RISER BACKFILLING DURING INVESTMENT CASTING

(75) Inventors: Steven J. Bullied, Pomfret Center, CT (US); Carl R. Verner, Windsor, CT (US); Mario P. Bochiechio, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 424 days.

(21) Appl. No.: 12/032,839

(22) Filed: Feb. 18, 2008

(65) Prior Publication Data

US 2009/0205800 A1 Aug. 20, 2009

(51) Int. Cl.
*B22D 1/00* (2006.01)
*B22D 33/04* (2006.01)

(52) U.S. Cl. ..... 164/133; 164/137; 164/122.1; 164/361; 164/516

(58) Field of Classification Search ..... 164/133, 164/35, 122.1, 122.2, 361, 516, 335
See application file for complete search history.

(56) References Cited

U.S. PATENT DOCUMENTS 4,300,617 A 11/1981 Bauer
4,421,153 A 12/1983 Wilkinson et al.
6,350,404 B1 2/2002 Li et al.
6,637,500 B2 10/2003 Shah et al.
6,668,906 B2 12/2003 Burd
7,032,648 B2 4/2006 Bhangu et al.
7,134,475 B2 11/2006 Snyder et al.
7,231,955 B1 6/2007 Bullied et al.
7,234,506 B2 6/2007 Grunstra et al.
7,258,156 B2 8/2007 Santeler
7,270,170 B2 9/2007 Beals et al.
7,278,460 B2 10/2007 Grunstra et al.
7,278,463 B2 10/2007 Snyder et al.

FOREIGN PATENT DOCUMENTS

EP 0099687 2/1984

OTHER PUBLICATIONS

European Search Report dated May 5, 2009.

*Primary Examiner*—Kuang Lin
(74) *Attorney, Agent, or Firm*—Carlson, Gaskey & Olds PC

(57) ABSTRACT

Systems and methods for reducing the potential for riser backfilling during investment casting are provided. In this regard, a representative method for performing investment casting includes: providing a mold having an opening communicating with an interior, the interior having a part cavity and a riser; providing an insert; and using the insert to form a physical barrier to reduce a potential for molten metal to backfill into the riser while the molten metal is introduced into the interior of the mold via the opening.

13 Claims, 3 Drawing Sheets

SYSTEMS AND METHODS FOR REDUCING THE POTENTIAL FOR RISER BACKFILLING DURING INVESTMENT CASTING

BACKGROUND

1. Technical Field

The disclosure generally relates to investment casting.

2. Description of the Related Art

Investment casting is used for producing metal components. Oftentimes, the metal components are gas turbine components, such as single crystal turbine components. During an investment casting process, molten metal is poured into a ceramic mold that is shaped to form the component. Ceramic cores of the mold also can be used to produce internal cavities of the components.

SUMMARY

Systems and methods for reducing the potential for riser backfilling during investment casting are provided. In this regard, an exemplary embodiment of a system for reducing the potential for riser backfilling during investment casting comprises: a main body mold having an opening communicating with an interior, the interior having a part cavity and a riser, the opening being operative to permit filling of the part cavity with molten metal, the riser interconnecting the part cavity with the interior of the main body mold in a vicinity of the opening; and an insert sized and shaped to be inserted at least partially into the opening of the main body mold such that the insert forms a barrier operative to reduce the potential for riser backfilling with molten metal introduced into the main body mold via the opening during investment casting.

An exemplary embodiment of a method for performing investment casting comprises: providing a mold having an interior, the interior having a part cavity and a riser; separating a portion from the mold; and using the portion as an insert such that the insert forms a physical barrier to reduce a potential for molten metal to backfill into the riser while the molten metal is introduced into the interior of the mold via the opening.

An exemplary embodiment of a method for performing investment casting comprises: providing a mold having an opening communicating with an interior, the interior having a part cavity and a riser; providing an insert; and using the insert to form a physical barrier to reduce a potential for molten metal to backfill into the riser while the molten metal is introduced into the interior of the mold via the opening.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Systems and methods for reducing the potential for riser backfilling during investment casting are provided, several exemplary embodiments of which will be described in detail. In this regard, some embodiments involve the use of a pourcone that is integrally formed with an investment casting mold. After separation from the mold, the pourcone is inverted and at least partially inserted within an upper opening of the mold. This orientation enables the pourcone to obstruct risers that are located in a vicinity of a pourcup of the mold. The risers are ports located at the ends of passages that communicate between the pourcup and part cavities of the mold. By obstructing the risers, the potential for molten metal backfilling through the risers during filling of the mold via the pourcup is reduced. Notably, such backfilling can potentially contaminate the components that are to be formed by the mold by introducing impurities and/or otherwise hindering the formation of single crystal metal components within the part cavities.

Figure 1:
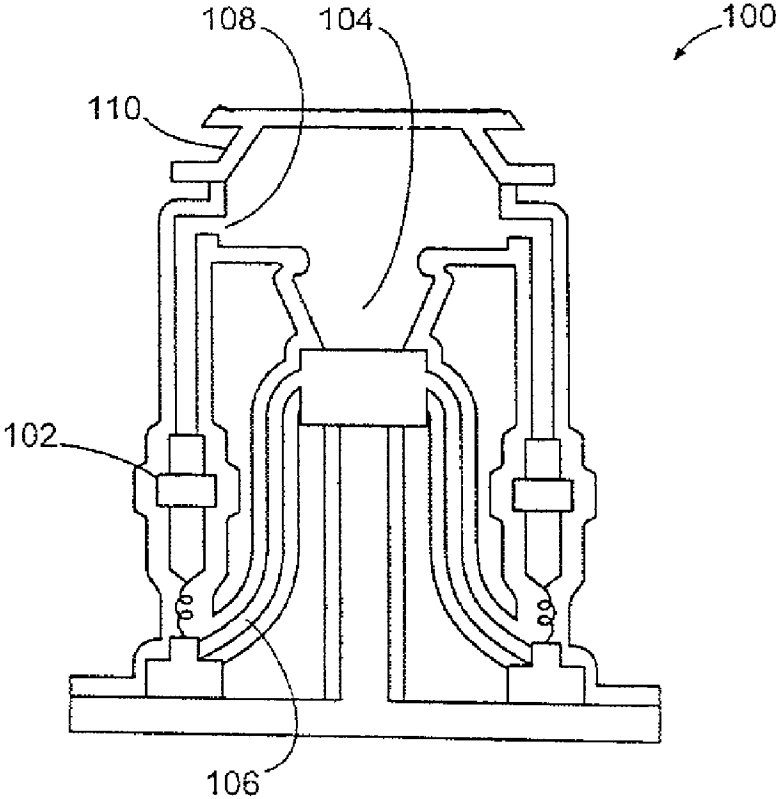
FIG. 1 is a schematic, cross-sectional view depicting an embodiment of mold.

FIG. 1 is a schematic diagram depicting an exemplary embodiment of a mold. As shown in FIG. 1, mold 100 incorporates part cavities (e.g., part cavity 102), each of which is configured to form a desired component. In the embodiment of FIG. 1, the part cavities are configured to produce gas turbine engine components, which in this case are turbine blades.

In order to provide molten metal to the part cavities, a pourcup 104 is provided. Feeders (e.g., feeder 106) extend from the pourcup to route molten metal to the bottom portion of each of the part cavities so that the part cavities can be bottom fed, which tends to facilitate laminar filling and washing of impurities out through the upper portions of the part cavities. Risers (e.g., riser 108) interconnect the upper portions of the part cavities to the interior of the mold at locations above the pourcup.

Note that in FIG. 1, the pourcup is capped and, therefore, no opening is present for receiving molten metal. Specifically, the pourcup is capped by an insert 110 that is integrally formed with the mold. In this regard, the mold is typically created by a ceramic shelling process that involves submerging a wax pre-form (not shown) into a ceramic slurry. Removal of the pre-form from the ceramic slurry results in a ceramic-coated wax pre-form, with the mold resulting from a de-waxing procedure. In this regard, FIG. 2 is a perspective view of mold 100 of FIG. 1 following such a de-waxing process.

Figure 2:
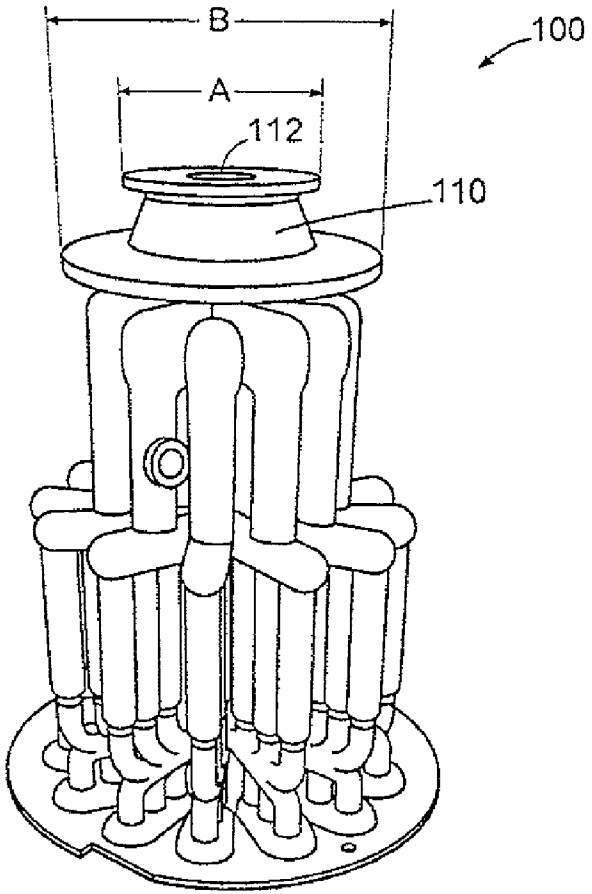
FIG. 2 is a perspective view of the embodiment of the mold of FIG. 1.
Figure 3:
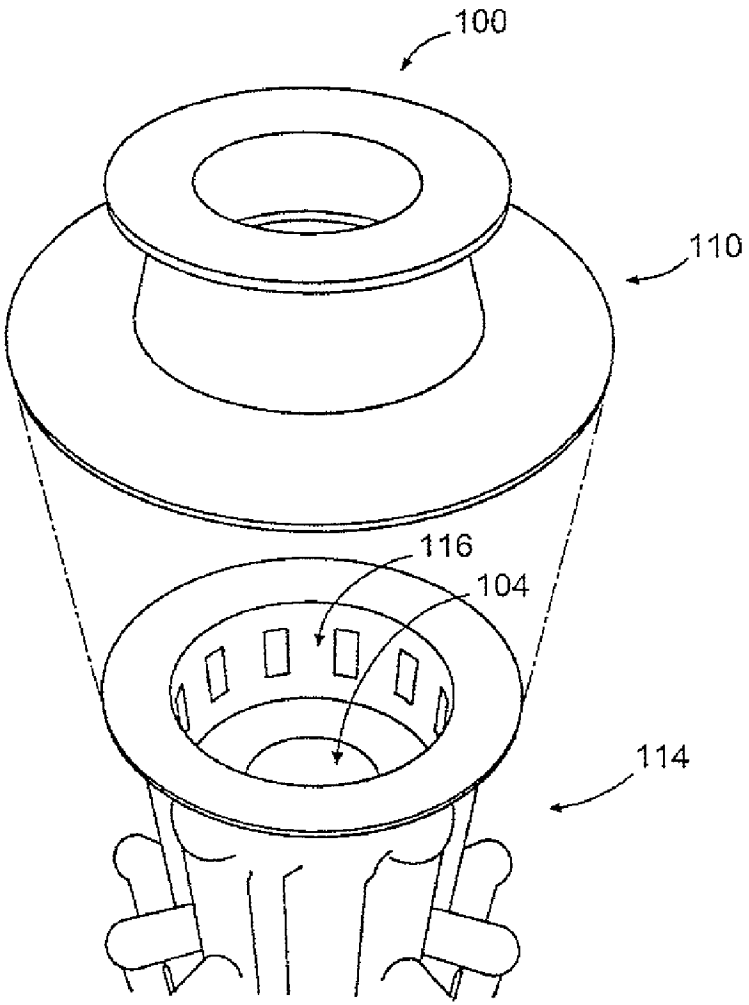
FIG. 3 is a perspective view of the mold of FIG. 2, showing an insert of the mold removed from the main mold body.

In FIG. 2, opposing pairs of arrows depicted wiping locations at which mold 100 is cut. In this embodiment, a rotating brush is used at location A to create an opening 112 in insert 110. At location B, the rotating brush is used to detach insert 110 from the main mold body 114. As shown in FIG. 3, removal of insert 110 from the main mold body reveals an opening 116, which provides access to pourcup 104.

Figure 4:
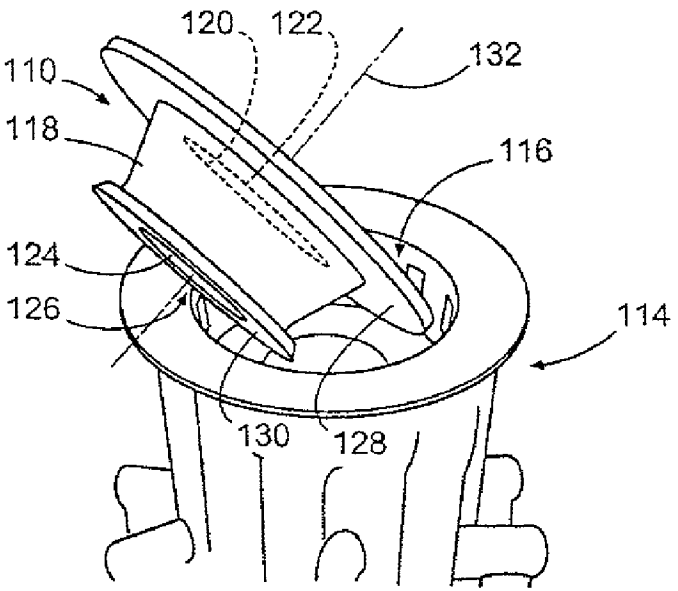
FIG. 4 depicts the embodiment of FIG. 3, with the insert partially inverted.

FIG. 4 shows insert 110 partially inverted and positioned adjacent to opening 116 of main mold body 114. As shown in FIG. 4, insert 110 incorporates a frusto-conical intermediate portion 118, with an opening 120 located at end 122 and a narrower opening 124 located at end 126. An annular flange 128 is located about end 122 and an annular flange 130 is located about end 126, with flange 128 extending farther radially from longitudinal axis 132 than flange 130.

Figure 6:
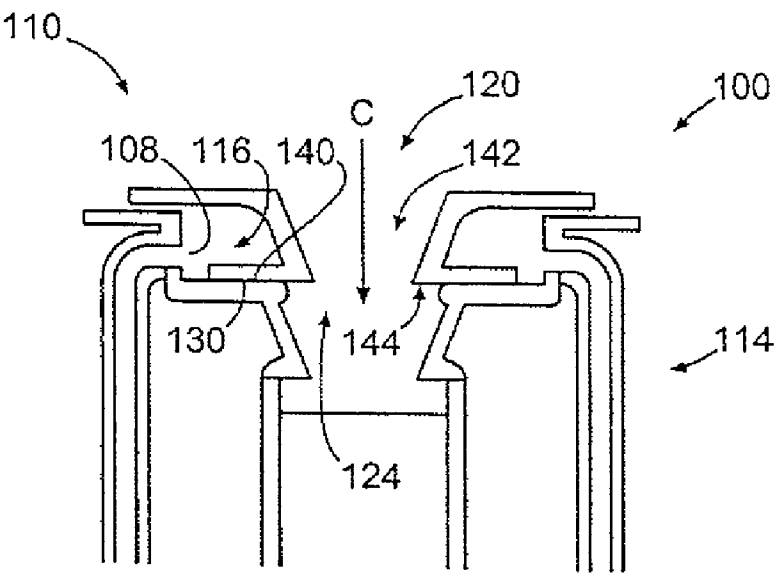
FIG. 6 is a schematic, cross-sectional view of the embodiment of FIG. 5.
Figure 5:
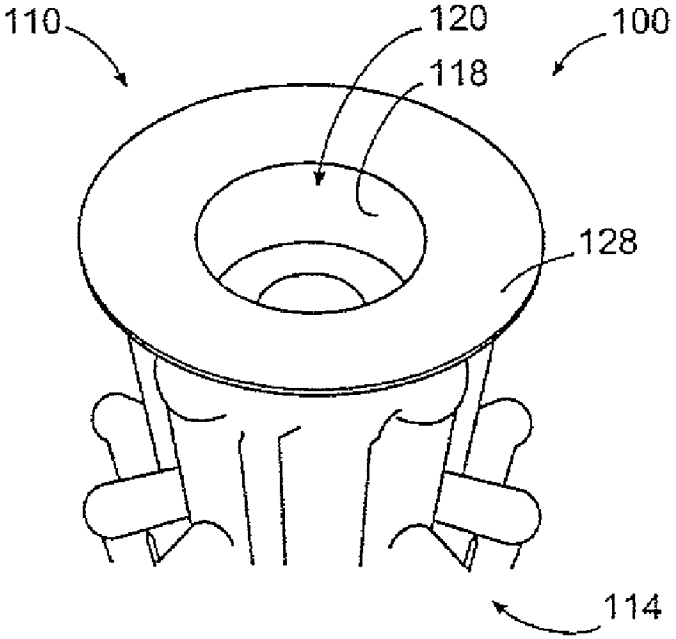
FIG. 5 the embodiment of FIG. 4, with the insert inverted and partially inserted within the opening of the main mold body.

As shown in FIG. 5 and the corresponding cross-sectional view of FIG. 6, when inserted into opening 116, contact between flange 130 of the insert and surface 140 of the main body portion prevents further movement of the insert into the opening. Since, opening 124 is smaller than upper opening 142 of the pourcup, a lip 144 is created. Lip 144 tends to direct molten metal that is poured into opening 120 of the insert into the pourcup. Additionally, the insert lines the passage between opening 116 of the main body portion and opening 142 of the pourcup, thereby forming a barrier between the molten metal (represented by arrow C) and the risers (e.g., riser 108).

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A method for performing investment casting comprising:

providing a mold having an interior, the interior having a part cavity and a riser communicating therewith;

separating a portion from the mold; and using the portion as an insert such that the insert forms a physical barrier to reduce a potential for molten metal to backfill from the part cavity into the riser while the molten metal is introduced into the interior of the mold via the opening.

2. The method of claim 1, wherein separating the portion from the mold comprises using a brush wheel.

3. The method of claim 1, wherein, in separating the portion from the mold, an opening communicating with the interior of the mold is revealed.

4. The method of claim 3, wherein, in using the portion as an insert, the portion is inverted and at least partially inserted into the opening of the mold.

5. The method of claim 3, wherein the insert has a frusto-conical intermediate portion with a first opening and a narrower second opening, the second opening being smaller than the opening of the main body mold.

6. The method of claim 1, further comprising forming a component using the molten metal.

7. The method of claim 6, wherein the component is a gas turbine engine component.

8. The method of claim 6, wherein the component is a single crystal metal component.

9. A system for reducing the potential for riser backfilling during investment casting comprising:

a main body mold having an opening communicating with an interior, the interior having a part cavity and a riser, the opening being operative to permit filling of the part cavity with molten metal, the riser interconnecting the part cavity with the interior of the main body mold in a vicinity of the opening; and an insert sized and shaped to be inserted at least partially into the opening of the main body mold such that the insert forms a barrier operative to reduce the potential for riser backfilling with molten metal introduced into the main body mold via the opening during investment casting wherein the insert has a frusto-conical intermediate portion with a first opening and a narrower second opening, the second opening being smaller than the opening of the main body mold; and the main body mold has a pourcup located within the interior thereof, the pourcup having an upper opening; and the second opening of the insert is smaller than the upper opening of the pourcup such that the insert forms a lip, the lip protruding radially inwardly toward a centerline of the pourcup.

10. A system for reducing the potential for riser backfilling during investment casting comprising:

a main body mold having an opening communicating with an interior, the interior having a part cavity and a riser, the opening being operative to permit filling of the part cavity with molten metal, the riser interconnecting the part cavity with the interior of the main body mold in a vicinity of the opening; and an insert sized and shaped to be inserted at least partially into the opening of the main body mold such that the insert forms a barrier operative to reduce the potential for riser backfilling with molten metal introduced into the main body mold via the opening during investment casting wherein the insert has a frusto-conical intermediate portion with a first opening and a narrower second opening, the second opening being smaller than the opening of the main body mold and wherein the insert has a first annular flange, a second annular flange, and an intermediate portion located between the first flange and the second flange.

11. The system of claim 10, wherein the first flange is larger than the opening of the main body mold such that insertion of the first flange within the opening is prevented.

12. A method for performing investment casting comprising:

providing a mold having an interior, the interior having a part cavity and a riser;

separating a portion from the mold; and using the portion as an insert such that the insert forms a physical barrier to reduce a potential for molten metal to backfill into the riser while the molten metal is introduced into the interior of the mold via the opening wherein the insert is integrally formed with the mold as a unitary structure and subsequently separated to reveal the opening.

13. A method for performing investment casting comprising:

providing a mold having an interior, the interior having a part cavity and a riser;

separating a portion from the mold; and using the portion as an insert such that the insert forms a physical barrier to reduce a potential for molten metal to backfill into the riser while the molten metal is introduced into the interior of the mold via the opening wherein the insert has a first annular flange, a second annular flange, and an intermediate portion located between the first flange and the second flange; and at least one of the first flange and the second flange is used to position the insert relative to the opening of the mold.

* * * * *